US009752778B2

(12) United States Patent
Jones

(10) Patent No.: US 9,752,778 B2
(45) Date of Patent: Sep. 5, 2017

(54) WALL MOUNTED PELLET STOVE

(71) Applicant: United States Stove Company, South Pittsburg, TN (US)

(72) Inventor: August Jones, Hixson, TN (US)

(73) Assignee: United States Stove Company, South Pittsburgh, TN (US)

( * ) Notice: Subject to any disclaimer, the term of this patent is extended or adjusted under 35 U.S.C. 154(b) by 488 days.

(21) Appl. No.: 13/788,949

(22) Filed: Mar. 7, 2013

(65) Prior Publication Data

US 2013/0255546 A1 Oct. 3, 2013

Related U.S. Application Data

(60) Provisional application No. 61/618,139, filed on Mar. 30, 2012.

(51) Int. Cl.

| | |
|---|---|
| ***F23N 1/00*** | (2006.01) |
| ***F23G 7/10*** | (2006.01) |
| ***F24B 1/02*** | (2006.01) |
| ***F23B 50/12*** | (2006.01) |
| ***F23L 17/00*** | (2006.01) |
| ***F23M 5/00*** | (2006.01) |
| ***F23K 3/14*** | (2006.01) |

(52) U.S. Cl.

CPC ..... *F23N 1/002* (2013.01); *F23B 50/12* (2013.01); *F23G 7/105* (2013.01); *F23K 3/14* (2013.01); *F23L 17/005* (2013.01); *F23M 5/00* (2013.01); *F24B 1/024* (2013.01); *F23G 2205/14* (2013.01); *F23G 2900/55007* (2013.01); *F23K 2203/202* (2013.01); *F23N 2025/02* (2013.01)

(58) Field of Classification Search

CPC ..... F23K 2203/202; F24B 1/08; F24B 13/04; F23B 50/12

See application file for complete search history.

(56) References Cited

U.S. PATENT DOCUMENTS 4,423,688 A * 1/1984 Kuo ..... F23G 5/30 110/110

5,105,797 A 4/1992 Gulutzen et al.

(Continued)

FOREIGN PATENT DOCUMENTS

| | | |
|---|---|---|
| EP | 2103872 A1 | 9/2009 |
| WO | 2006109346 | 10/2006 |

OTHER PUBLICATIONS

EP Supplemental Search Report dated Nov. 27, 2015 from EPO for corresponding Application No. 13768287.8.

*Primary Examiner* — David J Laux

(74) *Attorney, Agent, or Firm* — Mark A. Pitchford; Waller Lansden Dortch & Davis, LLP

(57) ABSTRACT

A wood pellet stove operable to mount to a wall includes a combustion chamber, a combustion chamber door, and a hopper. The combustion chamber has a front, back, and side. The combustion chamber door is in the front of the combustion chamber. The hopper is mounted at the side of the combustion chamber. The bottom of the hopper is below a top of the combustion chamber, and a top of the hopper is substantially coplanar with the top of the combustion chamber. The stove may also include a sight glass or fuel level monitoring system for determining a fuel level of the hopper without opening the hopper.

14 Claims, 4 Drawing Sheets

(56) References Cited

U.S. PATENT DOCUMENTS

| | | | | |
|---|---|---|---|---|
| 5,123,360 | A * | 6/1992 | Burke | F23B 50/12 110/102 |
| 5,285,738 | A | 2/1994 | Cullen | |
| 5,522,327 | A | 6/1996 | Buckner | |
| 6,336,449 | B1 * | 1/2002 | Drisdelle | F23B 1/36 110/110 |
| 7,686,011 | B1 | 3/2010 | Williams | |
| 2006/0236906 | A1 | 10/2006 | Buhr | |
| 2007/0137537 | A1 * | 6/2007 | Drisdelle | F23B 5/04 110/297 |
| 2007/0157858 | A1 * | 7/2007 | Gagner | F23B 30/10 110/102 |
| 2008/0066731 | A1 * | 3/2008 | Johnson | F23B 60/02 126/73 |
| 2009/0013985 | A1 * | 1/2009 | Little | F24B 1/028 126/67 |
| 2010/0251973 | A1 * | 10/2010 | Dongo | F23B 40/08 122/14.1 |
| 2010/0300428 | A1 * | 12/2010 | Bald | F24B 1/08 126/501 |
| 2011/0048398 | A1 * | 3/2011 | Christensen | F23B 10/00 126/77 |

* cited by examiner

WALL MOUNTED PELLET STOVE

CROSS-REFERENCES TO RELATED APPLICATIONS

This application claims benefit of the following patent application which is hereby incorporated by reference in its entirety: U.S. Provisional Patent Application No. 61/618,139 filed Mar. 30, 2012.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to pellet (e.g., wood) or biomass burning heating stoves. More particularly, this invention pertains to features and arrangements that provide a stove operable to mount on a wall.

Stoves are used to provide heat by burning a solid or pellet fuel such as wood pellets, cordwood, coal, or biomass. Pellet stoves are large appliances having a hopper storing wood pellets and a combustion chamber for burning the wood pellets. The hopper is typically located above and behind the combustion chamber of the pellet stove. An auger feeds fuel pellets from the hopper to the combustion chamber. To check the fuel supply (e.g., fuel or pellet level) in the hopper, the user must lift the top or lid off the hopper and physically check the pellet level. As a safety feature, lifting the top off the hopper causes the auger to stop, and in some models, combustion is constricted. Stopping the auger and constricting combustion reduces efficiency and increases emissions. Thus, checking fuel levels on pellet stoves requires a number of actions by a user, degrades the performance of the appliance, and reduces the time between required cleanings of the appliance. The only indication to a user that a stove has an empty fuel hopper is that the appliance stops producing heat.

Biomass and wood pellet stoves are generally used as alternatives to wood burning stoves. As such, biomass and wood pellet stoves are made with the same footprint, standing out several feet from the nearest wall and taking up valuable floor space in the room. Further, biomass and wood pellet stoves also have a combustion gas intake vent at the bottom rear of the stove and an air outlet at the top front of the stove to maximize airflow efficiency through the stove. This arrangement requires a roof top exhaust such as a chimney. Alternatively, the exhaust arrangement could go through the wall and terminate with a hood because the stove is a forced draft appliance. Additionally, the relatively low efficiency of prior art stoves required large hoppers for practical sustained operation. The weight of fuel in the hopper plus the weight of the furnace itself meant that the furnace had to rest on a floor capable of supporting the weight. These aspects limit application and consumer acceptance of biomass and wood pellet stoves stoves when compared with direct vent natural gas or propane heaters and central forced air heating systems.

BRIEF SUMMARY OF THE INVENTION

Aspects of the present invention provide a biomass or wood pellet stove operable to mount on a wall and provide the user with a fuel level without opening a hopper of the stove.

In one aspect, a stove includes a combustion chamber and a hopper. The combustion chamber has a front, back, and side. The hopper is mounted at the side of the combustion chamber.

In another aspect, a stove includes a combustion chamber, a hopper, at least one light emitter, an array of vertically aligned light receivers, and a controller. The combustion chambers operable to contain fuel during combustion. The hopper is operable to contain fuel for combustion in the combustion chamber. The at least one light emitter is on a first interior surface of the hopper near a top of the hopper, and the light emitter is operable to emit light. The array of vertically aligned light receivers is on a second interior surface of the hopper opposite the first interior surface of the hopper. Each light receiver of the array of vertically aligned light receivers is operable to provide an output signal indicative of whether the light receiver is receiving the emitted light from the at least one light emitter. The controller is operable to receive the output signal from each light receiver of the array of vertically aligned light receivers and determine a fuel level based on the received output signals.

In another aspect, a stove includes a combustion chamber, a combustion chamber door, and a hopper. The combustion chamber has a front, back, and side. The combustion chamber door is in the front of the combustion chamber. The hopper is mounted at the side of the combustion chamber. The bottom of the hopper is below a top of the combustion chamber, and a top of the hopper is substantially coplanar with the top of the combustion chamber.

In another aspect, a stove designed to be mounted on a wall of a user's home. The stove has an exhaust gas vent located at the rear of the stove such that the vent extends into or through the wall when mounted on the wall. The stove has a fuel hopper (i.e., container) mounted adjacent a combustion chamber of the stove when the stove is mounted on the user's wall. The fuel hopper has a sight glass which enables the user to determine a fuel level of the fuel hopper without opening a top of the fuel hopper.

In another aspect, a biomass or wood pellet stove includes a combustion chamber and an exhaust gas blower. The combustion chamber is operable to receive combustion air and fuel and produce combustion exhaust gases. The exhaust gas blower is in fluid communication with the combustion chamber. The exhaust gas blower includes a housing, and impeller, and a motor. The housing as a combustion air path and an exhaust air path. The combustion air path is operable to provide combustion air to the combustion chamber, and the exhaust air path is operable to receive combustion exhaust gases from the combustion chamber. The motor is in the combustion air path, and the impeller is in the exhaust air path. That is, the motor is sealed in the combustion air path, and the impeller is sealed in the exhaust air path.

In another aspect, a biomass or wood pellet stove includes a combustion chamber, a controller, and auger, and exhaust gas blower, a room air fan, and a room air temperature sensor. The combustion chambers operable to receive combustion air and fuel and produce combustion exhaust gases. The auger is responsive to the controller to provide fuel to the combustion chamber of the stove. The exhaust gas blower is responsive to the controller to draw combustion air into the combustion chamber of the stove and forced combustion exhaust gases out and exhaust gas vent of the stove when the exhaust gas blower is on. The room air fan is responsive to the controller to draw air across an exterior surface of the combustion chamber when the room air fan is on. The room air temperature sensor is operable to provide a signal indicative of the room air temperature to the controller. The room air temperature is a temperature of the air drawn across the exterior surface of the combustion chamber by the room air fan. The controller is operable to control the feed rate of the auger is a function of the room air temperature indicated by the room air temperature sensor.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

Figure 1:
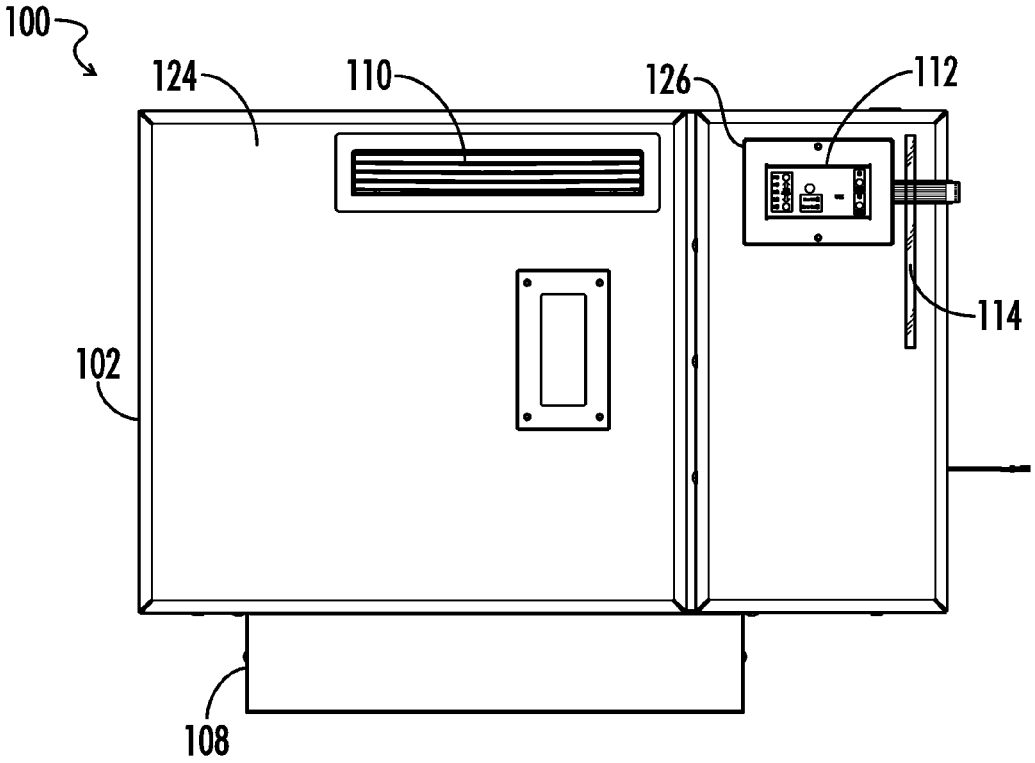
FIG. 1 is a front perspective view of a stove.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As used herein, terms indicating relative position such as above, below, beside, behind, in front of, under, over, inside, or outside refer to the relative position of components of a stove when the stove is properly mounted on a wall in an upright position and is viewed from the front, unless otherwise indicated.

In one embodiment, a wood pellet or automatic feed biomass stove is designed to be mounted on the interior wall of a home with the exhaust and intake vented to and from the exterior of the home, respectively, through a direct vent piping system. The stove has a combustion chamber, where the combustion of the fuel occurs (i.e., fuel and combustion air are combined to release heat, exhaust gases, and ash), and a heat exchanger (e.g., a plurality of fins extending from an enclosure of the combustion chamber), where heat from the combustion process can be transferred to convection air being cycled through the room. Being a pellet/biomass stove, there is a feed system such as an auger motor driving an auger. There are two blowers: one circulating air through the combustion system and the other circulating air across the combustion chamber and its heat exchanger. A hopper stores some amount of fuel so that combustion can be sustained over, at least, approximately an 8 hour period without refueling. The hopper includes a pellet level indicator that operates on a solid state control (i.e., an electronic fuel level monitoring system) or a sight glass that allows the user to know how close the stove is to needing refueling. This eliminates opening the hopper refill hatch to check the fuel level, such that the interlock that is typically used in a pellet stove and is set in-line electrically with the auger, will not interrupt the fuel (e.g., wood pellet) feed. The entire stove is secured to the wall through a mounting bracket or similar mechanism, and vented directly from the back of the stove through a wall of the room to outdoors. The pellet/automatic feed biomass fueled appliance is mounted to the wall and directly vented to the exterior of the home.

The configuration of a fuel hopper mounted to the side of a combustion chamber, reduces the overall depth of the appliance, allowing the stove to sit closer to the wall and avoiding taking up valuable space in the room. Mounting the pellet hopper to the side of the combustion chamber reduces the depth of the stove thereby limiting its intrusion into the living space of the room in which it is mounted. This enables biomass or wood pellet stoves to be used in rooms and locations where they otherwise would not be suitable.

In a standard appliance (i.e., stove), when the hopper lid (i.e., refill hatch) is opened, the burn process is halted. This is a safety feature to keep fingers out of a moving auger. A pellet level indicator (i.e., fuel level indicator) that operates through remote solid state control (e.g., an electronic fuel level monitoring system) or a sight glass that allows the user to know when to add fuel without opening the hopper refill hatch allows the combustion to remain continuous for longer periods thus increasing the stove's efficiency.

Referring to FIG. 1, a stove 100 is shown with a housing 102 supporting a combustion chamber 104 and a hopper 106 of the stove 100. The housing 102 includes a combustion chamber cover 124 and a hopper cover 126 as part of a front portion of the housing 102. An enclosure for the room air fan 108 is shown below the main housing 102. The combustion chamber cover 124 includes a room air outlet 110 for air taken into the housing 102 by the room air fan 108. The hopper cover 126 includes a control panel 112 and a sight glass 114. The sight glass 114 enables a user to determine a fuel level of the hopper 106 without opening the hopper cover 126 or a hopper lid 302 (see FIG. 3) in a top of the housing 102. It is contemplated that the control panel 112 may reside on any surface of the housing 102 within the scope of the claims. Similarly, the room air outlet 110 may be in the top of the housing 102 instead of in the combustion chamber cover 124 within the scope of the claims.

Figure 2:
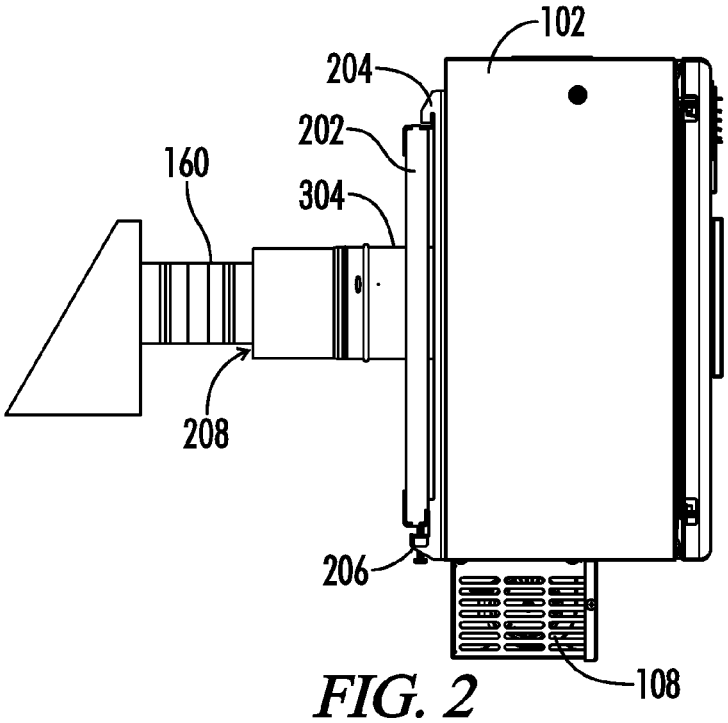
FIG. 2 is a side perspective view of a stove.
Figure 3:
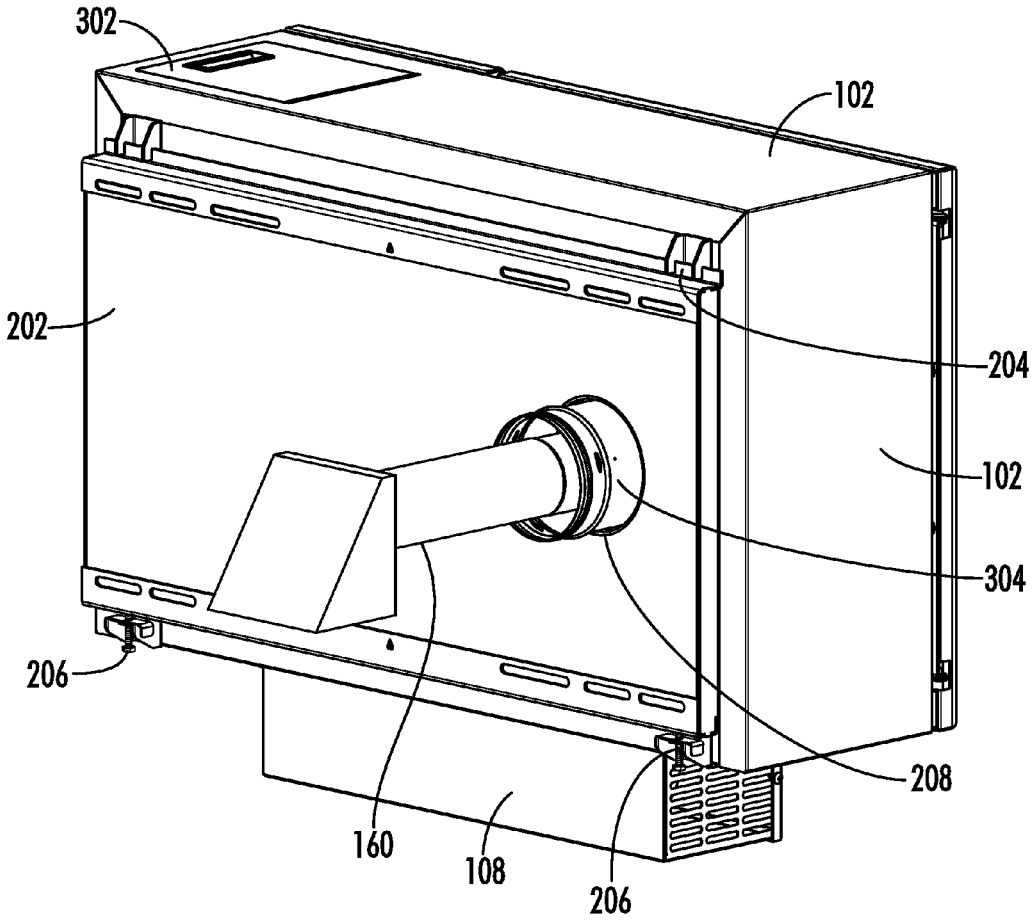
FIG. 3 is an isometric perspective rear view of a stove.

Referring to FIGS. 2 and 3, a wall mounting bracket 202 of the stove 100 is operable to affix to a wall to which the stove 100 is to be mounted. In one embodiment, the wall mounting bracket 202 is bolted (e.g., with lag bolts) to studs within the wall. The housing 102 has one or more hooks 204 for engaging (i.e., hooking over) a top lip of the wall mounting bracket 202 and attaching the housing 102 to the wall mounting bracket 202. The housing 102 also has one or more set screws 206 operable to engage (see i.e., hook behind) a bottom lip of the wall mounting bracket 202. The wall mounting bracket 202 includes a hole 208 for receiving an exhaust gas vent 160 from exhaust gas blower 162 of the stove 100. An exhaust gas vent cover 304 extends through a wall to which the wall mounting bracket 202 is mounted from a housing of the exhaust gas blower 162, or from the wall mounting bracket 202. The exhaust gas blower 162 is in fluid communication with the combustion chamber 104 and is operable to draw exhaust gases from the combustion chamber 104. The exhaust gas blower 162 exhausts the combustion exhaust gases through the exhaust gas vent 160. The exhaust gas vent cover 304 is concentric with the exhaust gas vent 160, and there is a gap between the exhaust gas vent 160 and the exhaust gas vent cover 304 such that the exhaust gas vent cover 304 shields the wall from heat radiated from the exhaust gas vent 160. The exhaust gas vent 160 receives combustion exhaust gases drawn from the combustion chamber 104 by the exhaust gas blower 162, and exhausts the gases outside of a building in which the stove 100 is mounted through the exhaust gas vent 160. In one embodiment, the exhaust gas vent cover 304 extends substantially perpendicularly from a back of the stove 100 (e.g., wall mounting bracket 202) which is operable to mount to the wall.

Figure 4:
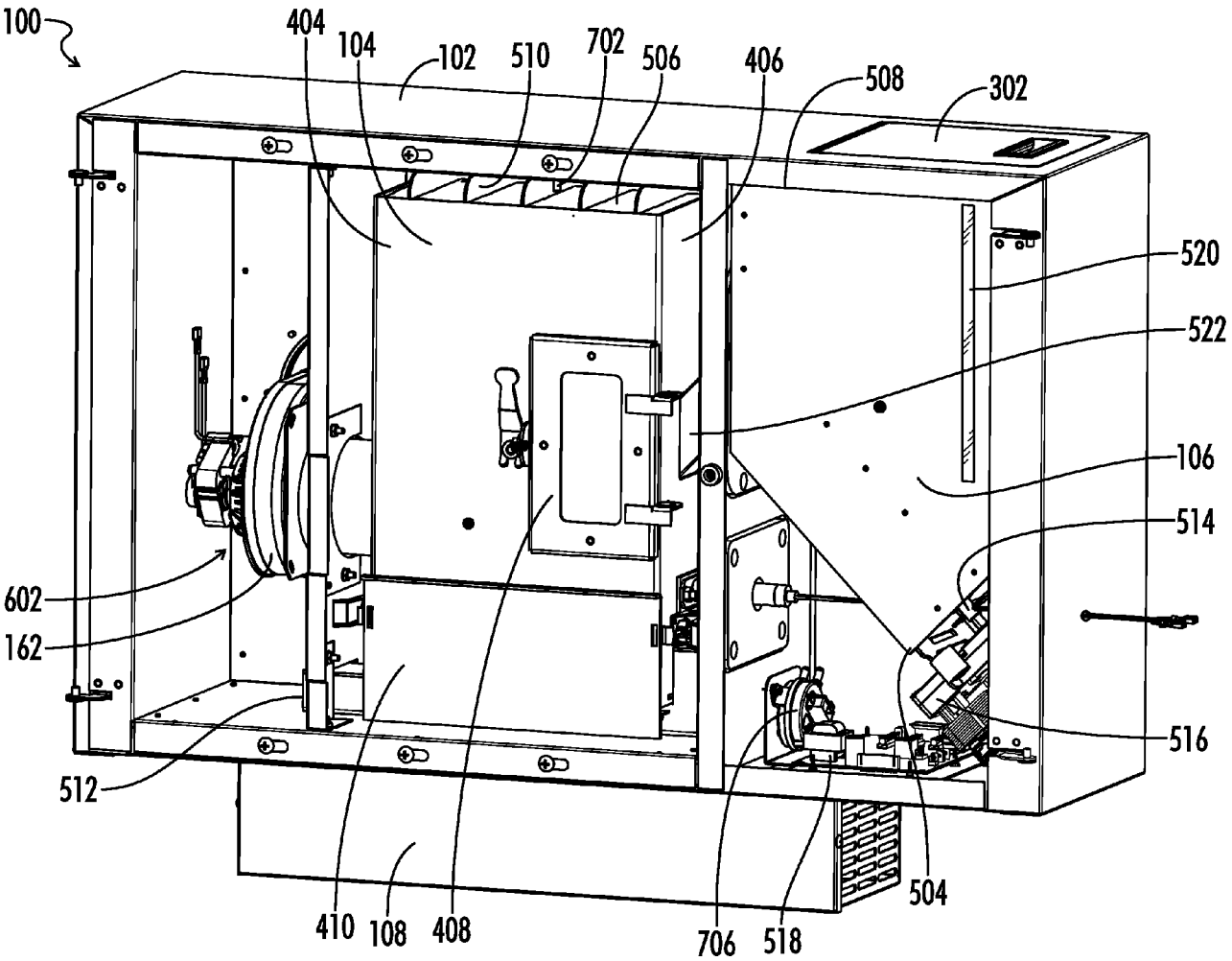
FIG. 4 is an isometric perspective view of a stove with a front cover of the stove removed.
Figure 5:
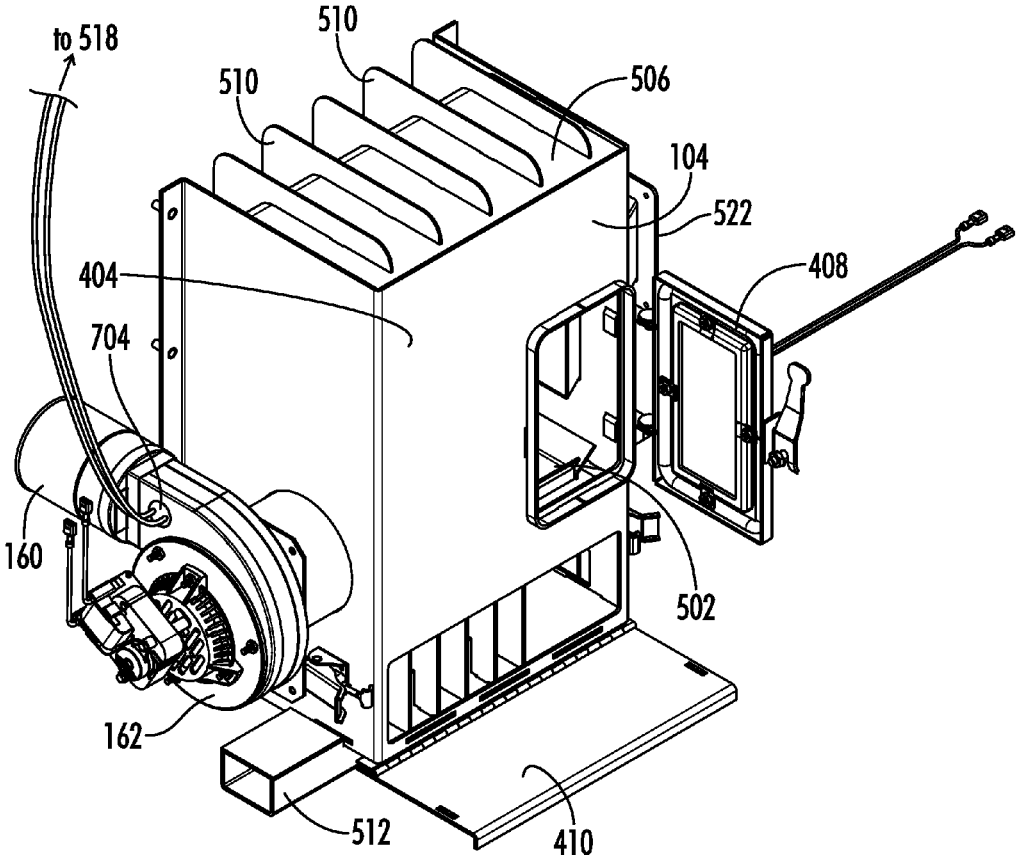
FIG. 5 is an isometric perspective view of a combustion chamber and exhaust gas blower of a stove.

Referring to FIGS. 4 and 5, the stove 100 of FIGS. 1-3 is shown with the front cover 124 and 126 of the housing 102 removed. The stove 100 includes the combustion chamber 104 and the hopper 106. The combustion chamber 104 has a front 404, back, and side 406. The hopper 106 is mounted at the side of the combustion chamber 104. The combustion chamber 104 includes a combustion chamber door 408 in the front 404 of the combustion chamber 104. The combustion chamber door 408 aids in cleaning out the combustion chamber 104, particularly a burn pot 502 of the combustion chamber 104. The combustion chamber 104 also includes a cleanout door 410 below the burn pot 502 which enables a user to clean out the combustion chamber 104 area below the burn pot 502.

In one embodiment, a combustion air intake 512 extends from the bottom of the combustion chamber 104. The exhaust gas blower 162 includes a motor and an impeller (i.e., fan). The impeller is operable to draw combustion air into the combustion chamber 104 through the combustion air intake 512 when driven by the motor. In one embodiment, the exhaust gas blower 162 is mounted in and substantially sealed in a blower motor chamber 602 of the housing 102. The housing of the exhaust gas blower 162 includes a combustion air path operable to provide combustion air to the combustion chamber 104 and an exhaust air path operable to receive combustion exhaust gases from the combustion chamber 104. In the combustion air path, combustion air is drawn into the blower motor chamber 602 through the gap between the exhaust gas vent 160 and the exhaust gas vent cover 304. The gap between the exhaust gas vent 160 and the exhaust gas vent cover 304 is in fluid communication with the combustion air path of the housing of the exhaust gas blower 162. The combustion air entering the blower motor chamber 602 passes across windings of the motor of the exhaust gas blower 162. The combustion air in the blower motor chamber 602 is then drawn into the combustion chamber 104 through the combustion air intake 512 extending into the blower motor chamber 602. In the combustion chamber 104, the combustion air is combined with fuel in the burn pot 502 (and ignited) to release combustion exhaust gases, heat, and ash. In the exhaust air path, the combustion exhaust gases are drawn from the combustion chamber 104 to the exhaust gas blower 162 and from the exhaust gas blower 162 out the exhaust gas vent 160 by the impeller or fan of the exhaust gas blower 162. The impeller is sealed in the exhaust air path. The exhaust gas vent 160 is connected to the housing of the exhaust gas blower 162 such that the exhaust gas vent 160 is in fluid communication with the exhaust air path. The exhaust gas vent 160 receives combustion exhaust gases drawn from the combustion chamber 104 by the impeller of the exhaust gas blower 162 and discharges the exhaust gases through the wall to which the stove 100 is mounted. In one embodiment, the concentric exhaust gas vent 160 and exhaust gas vent cover 304 operate as a heat exchanger to preheat combustion air and reduce the temperature of the combustion exhaust gases exiting the exhaust gas vent 160. Preheating the combustion air increases the efficiency of the stove 100, and reducing the temperature of the exhaust gases makes the stove 100 safer during operation.

In one embodiment, a bottom 504 of the hopper 106 is below a top 506 of the combustion chamber 104. A top of the hopper 106 is substantially coplanar with the top 506 of the combustion chamber 506. The top 506 of the combustion chamber 104 may be considered to be a top of the enclosure of the combustion chamber 104, or a top of one or more of a plurality of heat conducting fins 510 extending from the enclosure of the combustion chamber 104. The plurality of the conducting fins 510 extend substantially perpendicularly from the enclosure of the combustion chamber 104 such that the fins 510 are vertical when the combustion chamber 104 is in an upright position (e.g., mounted to the wall). In one embodiment, the housing 102 supporting the combustion chamber 104 and hopper 106 substantially enclose the combustion chamber 104, hopper 106, and the plurality of heat conducting fins 510. In another embodiment, the hopper 106 is external to the main housing 102. The room air fan 108 is operable to move air across an exterior of the combustion chamber 104 and the plurality of the conducting fins 510 and out of the housing 102 through the room air outlet 110.

The stove 100 also includes an auger 514 driven by an auger motor 516, a chute 522, a controller 518, a thermostat, and an igniter. The auger 514 is operable to move fuel from the hopper 106 to the combustion chamber 104 when driven by the auger motor 516 in response to commands from (e.g., receiving power from) the controller 518. The chute 522 connects the side 406 of the combustion chamber 104 to an adjacent side of the hopper 106. In operation, the auger 514 lifts fuel out of the hopper 106 to the chute 522, and the lifted fuel slides down the chute 522 into the combustion chamber 104 (i.e., the burn pot 502). The burn pot 502 is located in the combustion chamber 104 and is operable to receive and contain fuel sliding down the chute 522 from the hopper 106 during combustion. The thermostat is operable to provide a temperature signal indicative of a temperature of the room in which the stove is mounted to the controller 518. The controller 518 is operable to control the auger motor 516 and the igniter is a function of the temperature signal from the thermostat.

In one embodiment, the side of the hopper 106 facing the combustion chamber 104 is a first side, and a second side of the hopper 106 is opposite the first side of the hopper 106. The hopper 106 has a substantially transparent vertical portion (i.e., a sight glass 520) on a front of the hopper 106 or the second side of the hopper 106. The substantially transparent portion 520 enables a user of the stove to determine a fuel level of the hopper without opening hopper (i.e., without opening the hopper cover 126 and/or the hopper lid 302 which, for safety reasons, would stop the operation of the auger 514. In embodiments where the hopper 106 is covered by the hopper cover 126, the hopper cover 126 includes a substantially transparent portion 114 (e.g., sight glass) corresponding to the substantially transplant portion of the hopper 520 to enable the user to view the fuel level of the hopper without opening the hopper cover 126.

In one embodiment, the stove 100 includes an electronic system for determining the fuel level of the hopper 106. In this embodiment, the stove 100 includes at least one light emitter on a first interior surface of the hopper 106 near the top of the hopper 106. The light emitter is operable to emit light in response to receiving power from the controller 518. Stove 100 also includes an array of vertically aligned light receivers on a second interior surface of the hopper 106 opposite the first interior surface of the hopper 106. Each light receiver of the array of vertically aligned light receivers is operable to provide an output signal indicative of whether the light receiver is receiving the emitted light from the light emitter. In one embodiment, the at least one light emitter is an infrared light emitting diode, and each receiver of the array of vertically aligned light receivers is an infrared receiver (e.g., infrared photodiode). In embodiments including this electronic fuel level monitoring system, the hopper may be substantially opaque such as to prevent interference with system operation from light outside the hopper 106.

The controller 518 receives the output signal from each light receiver of the array of vertically aligned light receivers and determines a fuel level of the hopper 106 based on the received output signals. In one embodiment, the controller 518 provides a fuel level signal indicative of the determined fuel level in the hopper 106 to a display. The display is operable to receive the fuel level signal from the controller 518 and provide a visual display indicative of the fuel level of the hopper 106 to a user. In one embodiment, the display may be integral with the control panel 112 of the stove 100. In another embodiment, the display is an array of light emitting diodes arranged on the front of the housing 102, and the fuel level is indicated by the number of lighted light emitting diodes in the array. In another embodiment, the display is separate from the stove 100, and the stove 100 (e.g., the controller 518) provides the determined fuel level signal to the display by transmitting the fuel level signal to a computing device. The computing device may be, for example, a smartphone associated with the user and the stove 100. The computing devices connected to the stove 100 via a communications network.

In one embodiment, the biomass or wood pellet stove 100 includes the combustion chamber 104, the controller 518, the auger 514, the exhaust gas blower 162, the room air fan 108, and a room air temperature sensor 702. The combustion chamber 104 is operable to receive combustion air and fuel and produce combustion exhaust gases. The auger 514 and the auger motor 516 are responsive to the controller 518 to provide fuel to the combustion chamber 104 of the stove 100 as previously described herein. The exhaust gas blower 162 draws combustion air into the combustion chamber 104 of the stove 100 and forces combustion exhaust gases out the exhaust gas vent 160 of the stove 100, when the exhaust gas blower 162 is on. The room air fan 108 forces room air across an exterior surface of the combustion chamber 104 when the room air fan 108 is on. The room air fan 108 and the exhaust gas blower 162 are responsive to the controller 518 for turning on and off (e.g., the controller 518 selectively provides power to the room air fan 108 and the exhaust gas blower 162). The room air temperature sensor 702 provides a signal indicative of a room air temperature. The room air temperature is a temperature of the air drawn across the exterior surface of the combustion chamber 104 by the room air fan 108. The controller 518 controls a feed rate of the auger 514 as a function of the room air temperature indicated by the room air temperature sensor 702. In one embodiment, the stove 100 also includes an exhaust gas temperature sensor 704 operable to provide a signal indicative of an exhaust gas temperature. The exhaust gas temperature is a temperature of combustion exhaust gases forced out of the stove 100 by the exhaust gas blower 162.

Generally, the controller 518 has three operating modes: a startup mode, a running mode, and a shutdown mode. Under normal operating conditions, the startup mode lasts about 15 to 20 minutes, the running mode lasts while there is fuel in the hopper, and the shutdown mode engages periodically as dictated by the thermostat of the stove 100 and a temperature set point of the thermostat. From the startup and running modes, the controller 518 enters the shutdown mode if the exhaust gas temperature increases to a predetermined safety threshold. In one embodiment, the predetermined safety threshold is about 575° F. The shutdown mode ultimately turns off the exhaust gas blower 162 and room air fan 108. If the exhaust gas temperature increases to the predetermined safety threshold, the controller 518 sets an error code and enters an error state. In the startup mode, the controller 518 turns on the room air fan 108 when the room air temperature reaches a predetermined room air temperature threshold. The controller 518 switches from the startup mode having a predetermined feed rate profile for the auger 514 to the running mode in response to the exhaust gas temperature reaching a predetermined operating temperature threshold. In the running mode, the controller 518 controls the feed rate of the auger 514 as a function of the room air temperature indicated by the room air temperature sensor 702. In one embodiment, this feed rate as determined based on the room air temperature via a proportional integral derivative algorithm (i.e., via a PID control scheme). As in the startup mode, in the running mode, the controller 518 enters the shutdown mode and sets the error code if the exhaust gas temperature increases to the predetermined safety threshold. In the running mode, the controller is operable to enter the shutdown mode if the exhaust gas temperature falls below a fuel out temperature threshold. That is, in the running mode, the exhaust gas temperature falling below the fuel out temperature threshold is indicative of the hopper running out of fuel for the auger 514 to provide to the combustion chamber 104. Additionally, in the running mode, the controller 518 is operable to turn off the room air fan 108 if the room air temperature falls below a first efficiency threshold and turn the room air fan back on when the room air temperature rises back above a second efficiency threshold. In one embodiment, the second efficiency threshold is greater than the first efficiency threshold. For example, the first efficiency threshold may be about 90° F. while the second efficiency threshold is about 120° F. This maintains the fuel burn efficiency of the stove 100 when the stove is used in conditions outside of the recommended range (e.g., the stove 100 is used to heat a room beyond the design limits of the stove 100). In the shutdown mode, the controller 518 turns off the exhaust gas blower 162 when the exhaust gas temperature falls to a first cutoff threshold, and the controller 518 turns off the room air fan when the room air temperature falls to a second cutoff threshold. The first and second cutoff threshold may be the same temperature or different temperatures. The temperature thresholds and limits disclosed herein vary as a function of usage application, design, and materials of the stove 100.

In one embodiment, the stove 100 also includes a hopper lid switch, housing switch, and a differential pressure sensor 706. The hopper lid switch is operable to provide the controller 518 with a signal indicative of whether the hopper lid 302 of the stove 100 is open. The housing switch is operable to provide the controller 518 a signal indicative of whether the housing 102 (i.e., a door of the housing 102) is open. The differential pressure sensor 706 is operable to provide the controller 518 with a signal indicative of a pressure difference between combustion air in combustion exhaust gases. The controller turns off the auger 514 exhaust gas blower 162 and room air fan 108 in response to determining that the housing 102 is open (i.e., a door of the housing 102 is open), the hopper lid 302 is open, or that there is no pressure difference between the combustion air in the combustion exhaust gases (i.e., that the exhaust gas blower 162 is not operating properly or that there is an air leak in the combustion air path or exhaust air path).

It will be understood by those of skill in the art that information and signals may be represented using any of a variety of different technologies and techniques (e.g., data, instructions, commands, information, signals, bits, symbols, and chips may be represented by voltages, currents, electromagnetic waves, magnetic fields or particles, optical fields or particles, or any combination thereof). Likewise, the various illustrative logical blocks, modules, circuits, and algorithm steps described herein may be implemented as electronic hardware, computer software, or combinations of both, depending on the application and functionality. Moreover, the various logical blocks, modules, and circuits described herein may be implemented or performed with a general purpose processor (e.g., microprocessor, conventional processor, controller, microcontroller, state machine or combination of computing devices), a digital signal processor ("DSP"), an application specific integrated circuit ("ASIC"), a field programmable gate array ("FPGA") or other programmable logic device, discrete gate or transistor logic, discrete hardware components, or any combination thereof designed to perform the functions described herein. Similarly, steps of a method or process described herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. Although embodiments of the present invention have been described in detail, it will be understood by those skilled in the art that various modifications can be made therein without departing from the spirit and scope of the invention as set forth in the appended claims.

A controller, processor, computing device, client computing device or computer, such as described herein, includes at least one or more processors or processing units and a system memory. Examples of computing devices include cellular telephones, tablet computers, laptop computers, desktop computers, and consumer electronics devices including a processing units and system memory. The controller may also include at least some form of computer readable media. By way of example and not limitation, computer readable media may include computer storage media and communication media. Computer readable storage media may include volatile and nonvolatile, removable and non-removable media implemented in any method or technology that enables storage of information, such as computer readable instructions, data structures, program modules, or other data. Communication media may embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful WALL MOUNTED PELLET STOVE it is not intended that such references be construed as limitations upon the scope of this invention except as set forth in the following claims.

What is claimed is:

1. A pellet stove comprising:

a combustion chamber having a front, back, and side; and a hopper mounted at the side of the combustion chamber, wherein:

the stove is configured to mount inside a room;

the back of the stove is configured to mount on a wall of the room such that the entire stove is supported by the wall;

the stove is configured to receive combustion air from outside the room and vent combustion exhaust gases to outside the room; and the stove is configured to radiate heat from the combustion chamber directly to the room.

2. The stove of claim 1, wherein:

the stove further comprises a combustion chamber door in the front of the combustion chamber;

a bottom of the hopper is below a top of the combustion chamber; and a top of the hopper is substantially coplanar with the top of the combustion chamber.

3. The stove of claim 1, further comprising:

an auger operable to move fuel from the hopper to the combustion chamber; and a chute connecting the side of the combustion chamber to a side of the hopper, wherein the auger is configured to lift fuel out of the hopper to the chute, and the lifted fuel slides down the chute into the combustion chamber.

4. The stove of claim 1, wherein the hopper has a first side facing the side of the combustion chamber, and the hopper has a substantially transparent vertical portion on a front of the hopper or a second side of the hopper opposite the first side such that a user of the stove can determine a fuel level of the hopper without opening the hopper.

5. The stove of claim 1, further comprising:

at least one light emitter on a first interior surface of the hopper near a top of the hopper, said light emitter operable to emit light;

an array of vertically aligned light receivers on a second interior surface of the hopper opposite the first interior surface, each light receiver of the array of vertically aligned light receivers operable to provide an output signal indicative of whether the light receiver is receiving the emitted light; and a controller operable to receive the output signal from each light receiver of the array of vertically aligned light receivers and determine a fuel level based on the received output signals, wherein:

the light emitter is an infrared emitter; and the light receivers of the array of vertically aligned light receivers are infrared receivers.

6. The stove of claim 1, further comprising:

at least one light emitter on a first interior surface of the hopper near a top of the hopper, said light emitter operable to emit light;

an array of vertically aligned light receivers on a second interior surface of the hopper opposite the first interior surface, each light receiver of the array of vertically aligned light receivers operable to provide an output signal indicative of whether the light receiver is receiving the emitted light;

a controller operable to:

receive the output signal from each light receiver of the array of vertically aligned light receivers;

determine a fuel level of the hopper based on the received output signals; and provide a fuel level signal indicative of the fuel level in the hopper; and a display operable to receive the fuel level signal from the controller and provide a visual display indicative of the fuel level of the hopper.

7. The stove of claim 1, further comprising:

at least one light emitter on a first interior surface of the hopper near a top of the hopper, said light emitter operable to emit light;

an array of vertically aligned light receivers on a second interior surface of the hopper opposite the first interior surface, each light receiver of the array of vertically aligned light receivers operable to provide an output signal indicative of whether the light receiver is receiving the emitted light;

a controller operable to:

receive the output signal from each light receiver of the array of vertically aligned light receivers;

determine a fuel level of the hopper based on the received output signals; and provide a fuel level signal indicative of the fuel level in the hopper; and a display operable to receive the fuel level signal from the controller and provide a visual display indicative of the fuel level of the hopper, wherein the display is an array of light emitting diodes, and the fuel level is indicated by the number of lighted light emitting diodes in the array.

8. The stove of claim 1, further comprising:

at least one light emitter on a first interior surface of the hopper near a top of the hopper, said light emitter operable to emit light;

an array of vertically aligned light receivers on a second interior surface of the hopper opposite the first interior surface, each light receiver of the array of vertically aligned light receivers operable to provide an output signal indicative of whether the light receiver is receiving the emitted light;

a controller operable to:

receive the output signal from each light receiver of the array of vertically aligned light receivers;

determine a fuel level of the hopper based on the received output signals; and provide a fuel level signal indicative of the fuel level in the hopper, wherein said providing the fuel level signal comprises transmitting the fuel level signal to a computing device via communications network, wherein the computing device provides a display to a user indicative of the fuel level of the hopper as a function of the transmitted fuel level signal.

9. The stove of claim 1, further comprising:

an exhaust gas vent cover extending substantially perpendicularly from a back of the stove;

an exhaust gas blower in fluid communication with the combustion chamber, wherein the exhaust gas blower is operable to draw exhaust gases from the combustion chamber; and an exhaust gas vent concentric with the exhaust gas vent cover and connected to the exhaust gas blower, wherein the exhaust gas vent is operable to receive combustion exhaust gases drawn from the combustion chamber by the exhaust gas blower.

10. The stove of claim 1, further comprising:

a wall mounting bracket operable to attach to a wall, said wall mounting bracket including an exhaust gas vent cover extending substantially perpendicularly from a back of the wall mounting bracket, wherein the back of the wall mounting bracket is operable to engage the wall; and a housing supporting the combustion chamber and hopper, wherein the housing is operable to attach to the wall mounting bracket, and an exhaust gas vent extends from a back of the housing through the exhaust gas vent cover of the wall mounting bracket when the housing is attached to the wall mounting bracket.

11. The stove of claim 1, further comprising:

a plurality of heat conducting fins extending substantially perpendicularly from the combustion chamber, wherein the fins are vertical when the combustion chamber is in an upright position;

a housing supporting the combustion chamber and hopper, and substantially enclosing the combustion chamber and the plurality of heat conducting fins; and a room air fan operable to move air across the plurality of heat conducting fins and out of the housing.

12. The stove of claim 1, further comprising:

an auger operable to move fuel from the hopper to the combustion chamber;

a chute connecting the side of the combustion chamber to a side of the hopper, wherein the auger is configured to lift fuel out of the hopper to the chute, and the lifted fuel slides down the chute into the combustion chamber;

a burn pot located in the combustion chamber and operable to receive and contain fuel sliding down the chute from the hopper during combustion;

a thermostat operable to provide a temperature signal indicative of a temperature of a room in which the stove is mounted to a wall of the room;

an igniter operable to ignite fuel in the burn pot;

a controller operable to control the auger and the igniter as a function of the temperature signal from the thermostat.

13. The stove of claim 1, wherein:

the combustion chamber is operable to receive combustion air and fuel and produce combustion exhaust gases; and the stove further comprises an exhaust gas blower in fluid communication with the combustion chamber, said exhaust gas blower comprising a housing, an impeller, and a motor, wherein the housing has a combustion air path operable to provide combustion air to the combustion chamber and an exhaust air path operable to receive combustion exhaust gases from the combustion chamber, wherein the motor is in the combustion air path and the impeller is in the exhaust air path.

14. The stove of claim 13, further comprising:

an exhaust gas vent connected to the exhaust gas blower housing, wherein the exhaust gas vent is in fluid communication with the exhaust air path such that the exhaust gas vent is operable to receive combustion exhaust gases drawn from the combustion chamber by the impeller of the exhaust gas blower; and an exhaust gas vent cover concentric with the exhaust gas vent such that a gap is formed between the exhaust gas vent cover and the exhaust gas vent, wherein the gap is in fluid communication with the combustion air path of the exhaust gas blower housing; wherein:

the motor is operable to drive the impeller;

when driven by the motor, the impeller draws combustion exhaust gases from the combustion chamber and forces the combustion gases out the exhaust gas vent, thereby drawing combustion air in through the gap between the combustion exhaust gas vent and the combustion exhaust gas vent cover;

the concentric exhaust gas vent and exhaust gas vent cover are operable as a heat exchanger to preheat combustion air and reduce a temperature of the combustion exhaust gases exiting the exhaust gas vent;

the combustion air is drawn through windings of the motor in order to cool the windings of the motor; and the exhaust gas blower is substantially sealed in a blower motor chamber of the stove and a combustion air intake of the combustion chamber extends into the blower motor chamber for receiving combustion air from the combustion air path of the exhaust gas blower.

* * * * *